United States Patent [19]

Hinze

[11] 4,064,726

[45] Dec. 27, 1977

[54] METHOD OF MANUFACTURING PRESSURE POTS HAVING A BAYONET CATCH, AND APPARATUS FOR CARRYING OUT SUCH METHOD

[76] Inventor: Dietrich Hinze, Breslauer Str. 9, 4730 Ahlen, Germany

[21] Appl. No.: 626,785

[22] Filed: Oct. 29, 1975

[30] Foreign Application Priority Data

Nov. 11, 1974 Germany ..... 2453374

[51] Int. Cl.[2] ..... B21D 51/24

[52] U.S. Cl. ..... 72/70; 72/82; 72/84; 72/115

[58] Field of Search ..... 72/82, 70, 84, 91, 110, 72/115; 53/334; 113/120 S, 120 CC

[56] References Cited

U.S. PATENT DOCUMENTS

| | | | |
|---|---|---|---|
| 1,304,939 | 5/1919 | Brinkman | 72/115 X |
| 1,421,507 | 7/1922 | Lindberg | 72/115 X |
| 2,472,620 | 6/1949 | Rhodes et al. | 113/120 CC |
| 2,490,880 | 12/1949 | Olson | 72/82 X |
| 2,573,736 | 11/1951 | Scavullo | 72/82 X |
| 2,698,122 | 12/1954 | Pechy | 53/334 X |

*Primary Examiner*—Othell M. Simpson
*Assistant Examiner*—Horace M. Culver
*Attorney, Agent, or Firm*—Fitch, Even, Tabin & Luedeka

[57] ABSTRACT

A method and apparatus for manufacturing pressure pots having a rim with bayonet cams on its undersurface includes a spinning operation to fold over the rim and to simultaneously form the bayonet cams. More specifically, the pot is held inside a chuck having an annular cam profile facing the underside of the rim and spinning rollers engage the upper face of the rim and fold over the rim increasing its thickness and forcing the metal in the rim to comform to the cam profile. The rim is confined on its radially outward side by an axially shiftable retaining ring and is confined on its radially inward side by a counterholder cylinder. After folding over of the rim, the upper face of the rim is formed by machining or the like which may remove the metal between adjacent bayonet cams.

8 Claims, 4 Drawing Figures

METHOD OF MANUFACTURING PRESSURE POTS HAVING A BAYONET CATCH, AND APPARATUS FOR CARRYING OUT SUCH METHOD

The present invention relates to a method of manufacturing pressure (cooking) pots having a cylindrical wall and a rim provided with the cams of a bayonet catch, wherein there is first formed a pot-shaped structure having an edge or rim, optionally by a drawing operation on said wall, and said edge or rim is thereafter partially folded over by 90°, and to an apparatus for carrying out such method and comprising an inside chuck for receiving the pot-shaped structure, and spinning rollers for folding over the edge.

It is already known to manufacture pressure (cooking) pots in accordance with the spin forming process (published German patent application No. 1,652,630) wherein, by starting with a ronde or disc, a cylindrical blank having a bottom is formed first, which bottom has a greater wall thickness than the cylindrical walls, and whereby a double-stepped rim formed during the drawing of the walls is folded over by spinning. However, in this process it is impossible to simultaneously form a bayonet element of a bayonet catch during the deforming operation, such that a bayonet catch to be provided had to be formed afterwards by cutting manufacturing processes, e.g. by milling.

Further, it is known to manufacture pressure pots having a single- or double-stage bayonet catch by a casting method. In this method, the necessary finishing operations are of disadvantage which add to the well-known general disadvantages of the casting method.

Accordingly, it is the object of the present invention to manufacture by means of a simple method and an economically operable apparatus pressure (cooking) pots having a two-stage bayonet catch. Bayonet catches of this type are particularly advantageous because the pressure pots, for reasons of safety, must be constructed in such a manner in the future that the lid, when opened, cannot be removed immediately, but rather can only be disengaged initially in a first stage. When overpressure is still present at this point, this overpressure can escape. Then, the lid can be removed in a second stage where the lid is further opened.

Evidently, a bayonet catch of this type is of a more complicated structure than a bayonet catch known in conventional pressure pots, and the construction of the cams of such catch is therefore likewise more complicated, and the forming thereof is more expensive.

According to the present invention, the forming of the cams should be rendered possible by non-cutting shaping, whereby an easy facing or turning step only should be required for the final shaping.

On the whole the method and the apparatus according to the invention should allow to manufacture a modern pressure (cooking) pot in a particularly efficient manner and with particular great ease of operation, whereby the method should lend itself to be carried out easely and free from trouble, while the apparatus, too, should be easy to construct and efficient to operate; and, in particular, the mass production by fully automatic operation should be rendered possible.

According to the present invention, this object is solved in the method as outlined at the beginning, in that said bayonet projections or cams are formed in the lower face of the folded over rim portion during said folding over step, and thereafter the rim portion above said cams if faced or turned off.

Advantageously, the bayonet cams or projections may be faced also at their periphery, and also the edge may be upset during the folding over in order to obtain the required height of the cams.

Further, the object of the present invention is solved in an apparatus or spinning machine of the type mentioned at the beginning, in that the end face of said chuck is provided at its inner edge with a profile being formed complementary to the configuration of said cams of said bayonet catch, a movable retainer ring is disposed within said chuck to join said profile in outward direction, said spinning rollers include an actuating shoulder for moving said ring, and a counterhold cylinder is provided which extends into the interior of said pot and which is adapted to be advanced into said pot when said rollers are advanced.

In order to compensate for the high moments and forces resulting from the shaping operation, at least two spinning rollers may be mounted to a roller yoke supporting the counterhold cylinder and being adjustable through a pressure shaft.

In order to provide for positive driving of the pot by the inside chuck, the bottom of the pot may be pressed against the chuck by a counterhold disc which is movably mounted relative to the counterhold cylinder by a bolt and which is urged by the force of a spring through the cylinder.

Additionally, for the easier removal of the finally shaped pressure pot, an injector disc or plate may be provided in the inner end face of the inside chuck, which disc is adapted to be operated through a shaft from the main spindle.

It is surprising to the expert that the solution according to the present invention for the first time provides a pressure pot including its bayonet cams or projections by a spin forming process, whereby finishing is effected by an easy facing or turning off step. It is particularly surprising that a spin forming process allows to form rotationally non-symmetrical structures to be formed true to dimension.

Below, an exemplary embodiment of the present invention is explained by referring to the accompanying drawings, wherein.

The invention is particularly useful for the manufacture of pressure pots from aluminium, but in a further embodiment, the manufacture of pressure pots from other metallic and formable materials is possible as well.

Figure 1:
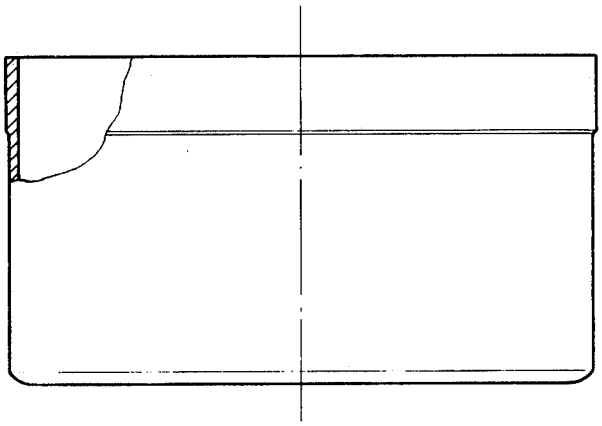
FIG. 1 shows the pot-shaped structure forming the starting workpiece of the shaping process.
Figure 2:
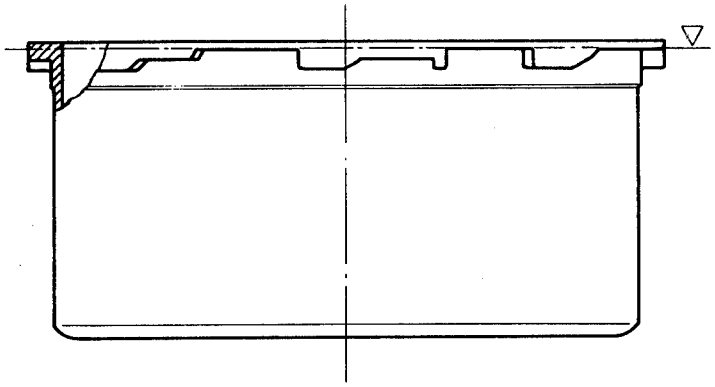
FIG. 2 shows the shaped pressure pot prior to facing or turning off the upper edge or rim portions.
Figures 3A, 3B:
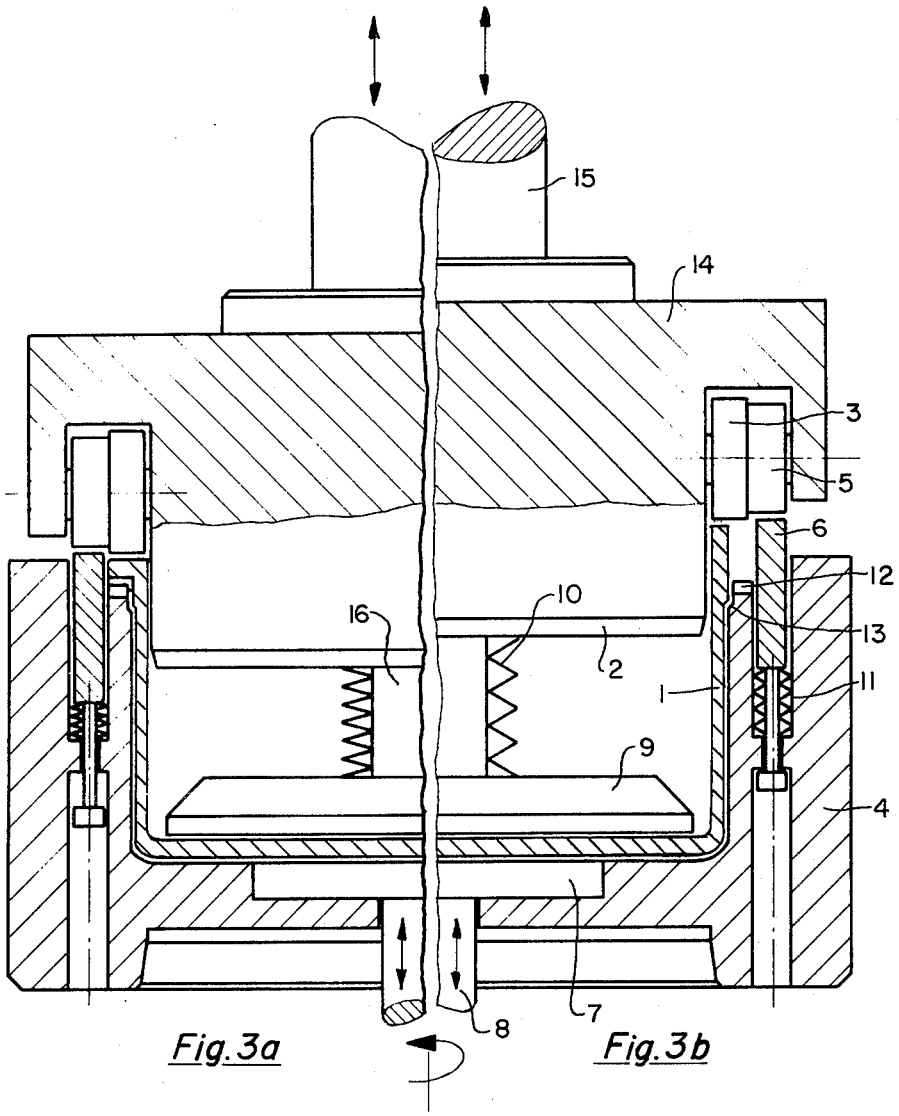
FIG. 3 shows a schematical sectional view of the shaping portion of a spinning machine according to the invention, whereby the view illustrates at the right hand side the initial step of the shaping operation and at the left hand side the final state of the shaping operation.

By using as the starting workpiece a pot-shaped structure according to FIG. 1 which may be formed, for instance, by pressing of a blank and drawing thereof while forming the edge or rim, the rim configuration shown in FIG. 2 is formed by a spinning and upsetting operation, whereupon the portion above the line identified by a machining mark is faced or turned off. Accordingly, the subsequent, expensive punching out in a press is omitted because the bayonet structure is preshaped to such degree that it is obtained with the desired and requisite precision already from the previously formed configuration merely by axial and radial facing or turning off (lathe machining) from the outer side to the inner side.

The apparatus for carrying out the method according to the invention includes an inside chuck into which the pot-shaped structure is inserted and which is adapted to be rotated in the conventional manner.

An ejector disc or plate 7 is provided within the bottom of the inner end face of the chuck 4, which disc is adapted to be actuated through a shaft 8 and which at the end of the manufacturing process ejects the pot by pressing against its bottom.

The chuck 4 has inserted thereinto a retainer ring 6 which reacts against the chuck by means of springs 11 and which can be retracted into the chuck 4 by the shoulders 5 of spinning rollers 3 in response to the advance or adjustment of the rollers.

The rollers 3, 5 are mounted on a roller yoke 14 which is adapted to be advanced e.g. through the headstock by means of a pressure shaft 15. The center part of the roller yoke 14 teminates in a center or counterhold cylinder 2 which is inserted into the interior of the pot-shaped structure and which backs up the inner edges of the cylindrical wall from the inside and over a distance below the edge or rim.

The pot-shaped structure 1 proper is pressed against the chuck 4 by means of a counterhold disc or plate 9 which is mounted on a bolt 16 and which reacts against the cylinder 2 through a spring 10. The bolt 16 is movable within a bore of the cylinder 2 so as to permit the yoke 14 and the cylinder 2 to be advanced relative to the counterhold disc 9.

In this construction, the spring force of spring 10 should be selected to be such that positive driving of the pot-shaped structure 1 between disc 9 and the end face of chuck 4 is ensured.

The inner edge portion of the outer end face of chuck 4 has a profile 12 shaped complementary to the subsequently formed bayonet cams. In this connection, "complementary" means that profile 12 has such cavities and gaps that the desired and required cam configuration is formed when the material is pressed into such profile.

The retainer ring 6 is now positioned directly outwards of the profile 12 thereby preventing material from being pressed outwards from the profiling zone when the edge is folded over or upset. The ring may be displaced by the shoulders 5 of spinning rollers 3 against the force exerted by springs 11, such that exact adjustment of the ring becomes possible.

Then, when the roller yoke 14 is advanced with a very high force of advance as compared with the normal forces of advance or adjustment, after the pot-shaped structure 1 has been inserted, the edge or rim portion of the pot is deformed in the contemplated manner within the space between roller 3, ring 6, cylinder 2 and profile 12. In addition to the high pressure of advance, the lateral confinement of the deforming space as provided by cylinder 2 and ring 6 as well as the provision, namely that the edge of the rim of the pot is supported at 13 in a step of the inside chuck such that the cylindrical wall cannot be folded in axial direction, are decisive.

As explained at the beginning, the finishing operations of the pressure pot can easily be performed by axial and radial facing or turning off, whereby the protruding rim is faced to such degree that the shaped cams 17 and 18 are exposed at the rim of the pot. Hereby, the degree of axial facing is indicated in FIG. 2 by the line identified by a machining mark.

Surprisingly, it is possible according to the invention to produce not only simple step-shaped cams 17 as according to FIG. 2, but also cams 18 having a pair of protruding outer portions and a deeper mid portion, such that the requirement of multi-stage opening of the pot can be fulfilled.

In a manner being obvious to one skilled in the art, material may be removed between the cams also by punching out or by milling. The rim formed by the upsetting step then at the same time represents the sealing edge such that facing can be omitted. What is left is the fundamental principle of forming the material of the cams by upsetting and folding over of the upstanding edge.

What we claim is:

1. A method of manufacturing pressure cooking pots having a cylindrical wall and an upper radially outwardly projecting rim having underlying cam surfaces for cooperation with a lid structure for the pot, said method comprising the steps of:

rotating said rim of said pot relative to spinning rollers, engaging an upper portion of said rim with said rollers and applying pressure for folding over said rim, engaging the undersurface of said folded over rim with a profile complementary to at least a portion of said underlying cam surfaces and forming said cam surfaces during the folding over of said rim, engaging the radially outer side of the folded over rim to limit outward movement of metal during the folding over and cam forming steps, and removing portions of said rim above said cam surfaces until gaps between adjacent portions of said cam surfaces are exposed to complete the formation of said rim.

2. A method in accordance with claim 1 in which said steps of removing said portion of said rim comprises turning off metal from the upper surface of said rim.

3. A method in accordance with claim 1 in which said rim is upset during the folding over step.

4. An apparatus for making pressure pots having a cylindrical wall, a bottom wall and an upper rim having cam surfaces formed in the under face of the rim, said apparatus including a rotatable chuck for receiving the pot, spinning rollers for engaging the outer face of the pot rim for folding over the rim, a profiled surface on said chuck opposite said spinning rollers for engaging the under face of said rim and forming said cam surfaces in said rim during the folding over of said rim by said spinning rollers, a retaining ring on said chuck movable in an axial direction for engaging said rim as it is being folded over to limit the radially outward directed extent of folding, means associated with said spinning rollers to move said retaining ring in said axial direction during the folding over of said rim, and a counterholder means for extending into said pot to hold the same against said chuck.

5. An apparatus according to claim 4 including a roller yoke having at least two of said spinning rollers mounted thereon and having said counterholder means supported thereon by a pressure shaft mounted for movement in the axial direction, said counterholder means being in the form of a cylinder connected to said shaft.

6. An apparatus according to claim 4 in which said counterholder means comprises a counterholder plate, and a spring means biasing said plate against the bottom wall of said pot.

7. An apparatus according to claim 4 comprising an ejector means insertable into said chuck to engage said pot and movable to eject said pot after folding over of said rim.

8. A method in accordance with claim 1 in which the removing of the portion of the rim comprises punching out of rim material between adjacent cam surfaces to space the same.

* * * * *